US006603887B1

(12) United States Patent
Focke et al.

(10) Patent No.: US 6,603,887 B1
(45) Date of Patent: Aug. 5, 2003

(54) PROCESS AND APPARATUS FOR DETECTING PRINTED MARKS

(75) Inventors: Heinz Focke, Verden (DE); Eckhard Grundmann, Bruchhausen-Vilsen (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/377,148

(22) Filed: Aug. 19, 1999

(30) Foreign Application Priority Data

Aug. 25, 1998 (DE) ..... 198 38 545

(51) Int. Cl.[7] ..... G06K 9/36; G06K 9/32; G06K 9/54; B65H 19/00; B65H 69/00

(52) U.S. Cl. ..... 382/287; 382/294; 382/306; 156/504; 242/554.1; 242/555.4

(58) Field of Search ..... 382/151, 190, 382/195, 287, 294, 306, 317; 156/157, 159, 351, 361, 502, 504, 350; 242/552, 554.1, 555.4, 420, 420.6, 554.2, 555.3

(56) References Cited

U.S. PATENT DOCUMENTS

| | | | | | |
|---|---|---|---|---|---|
| 2,536,153 | A | | 1/1951 | Bishop | 242/554.1 |
| 3,995,791 | A | * | 12/1976 | Schoppee | 242/421.7 |
| 4,067,760 | A | * | 1/1978 | Nelson | 156/157 |
| 4,859,270 | A | | 8/1989 | Martin et al. | 156/361 |
| 4,864,631 | A | * | 9/1989 | Jensen | 382/317 |
| 5,284,197 | A | | 2/1994 | Cederholm et al. | 156/350 |
| 5,316,230 | A | | 5/1994 | Focke et al. | 242/552 |
| 5,518,202 | A | * | 5/1996 | Focke et al. | 242/552 |
| 5,671,895 | A | * | 9/1997 | Cederholm et al. | 242/420.6 |
| 5,783,007 | A | * | 7/1998 | Boyd et al. | 156/64 |
| 5,820,280 | A | * | 10/1998 | Fox | 400/611 |
| 6,096,150 | A | * | 8/2000 | Ohno | 156/157 |

FOREIGN PATENT DOCUMENTS

| | | |
|---|---|---|
| DE | 1 147 599 | 11/1963 |
| DE | 1 474 241 | 8/1972 |
| DE | 27 31 914 | 1/1979 |
| DE | 29 27 575 | 1/1980 |
| DE | 32 19 308 | 11/1983 |
| DE | 35 27 446 | 2/1987 |
| DE | 34 26 976 | 12/1988 |
| DE | 37 27 339 | 3/1989 |
| EP | 117927 | 1/1983 |
| EP | 186750 | 11/1984 |
| EP | 237 022 | 3/1986 |
| EP | 211 291 A1 | 5/1987 |

* cited by examiner

*Primary Examiner*—Mehrdad Dastouri
(74) *Attorney, Agent, or Firm*—Sughrue Mion, PLLC

(57) ABSTRACT

The invention relates to a process and an apparatus for automatically detecting printed marks which are applied at regular spacings to material webs. The invention is based on the problem of improving the detection of printed marks when separate prints are applied between the printed marks in the same movement path of the printed marks. This problem is solved in that the widths of printed sections and the spacings between printed sections are determined and, if the width and spacing essentially correspond to predetermined values, a printed section is detected as being a printed mark.

6 Claims, 2 Drawing Sheets

PROCESS AND APPARATUS FOR DETECTING PRINTED MARKS

BACKGROUND OF THE INVENTION

The invention relates to a process for automatically detecting printed marks, which are applied at regular spacings to webs, in particular made of packaging material, from among printed sections which exhibit the printed marks and separate prints, which are applied at regular spacings in the same movement path as the printed marks. The invention also relates to an apparatus for carrying out the process, having a sensor for sensing the printed sections, and having an evaluation unit which is connected to the sensor.

The handling of the packaging material is of particular importance in the case of powerful packaging machines, and the level of manual labour to be used is to be kept as low as possible. Packaging machines predominantly process packing material in the form of long material webs provided as reels. When a finishing web is used up, the new web is intended to be connected to the finishing web as far as possible without manual intervention. This ensures continuous operation of the packaging machine.

In the case of printed packaging material with recurrent printing, the relative positioning of the finishing web and new web has to be taken into consideration when the two webs are connected. This is because, if the intention is to produce uniform blanks from the web, the blanks have to be connected to one another in a correctly positioned manner. In order to produce correctly positioned connection, the material webs are provided with printed marks which are printed on the web at blank-length spacings. Mark readers which detect the marks which are being printed on and control the connecting operation by way of the detected printed marks are known.

Disadvantageously, however, separate prints which are printed on between the printed marks are likewise detected, incorrectly, as printed marks by the known mark readers if these separate prints have a similar contour to the printed marks. This may result in incorrect operation of the packaging machine.

SUMMARY OF THE INVENTION

The invention is thus based on the problem of providing an improved detection of printed marks which also functions in a fault-free manner when separate prints are applied between the printed marks in the same movement path as the printed marks.

In order to solve this problem, the process according to the invention is characterized in that the widths of the printed sections and the spacings between, in particular adjacent, printed sections are determined and, if the width and spacing essentially correspond to predetermined values, a printed section is detected as being a printed mark.

An apparatus according to the invention is characterized, in order to solve this problem, in that the evaluation unit is designed such that, by way of a sensor signal, the widths of the printed sections and the spacings between, in particular adjacent, printed sections can be determined and, if the width and spacing essentially correspond to predetermined values, it is possible for a printed section to be detected as a printed mark.

According to the invention, the width of printed sections and the following empty spaces are detected and measured and compared with input reference values.

In the case of correspondence with the reference values, a printed section is detected as being a printed mark. It is thus possible to distinguish reliably between separate prints and printed marks. In particular, it is thus possible to avoid the situation where printed sections are detected incorrectly as printed marks.

The detected printed marks are used for controlling so-called splicing operations or operations for connecting a finishing material web to a new material web. In this case, during the connecting operation, the material webs are positioned such that, in the connecting region as well, the printed marks maintain the same spacings.

Furthermore, by virtue of printed-mark detection which continues throughout operation, it is possible to achieve constant monitoring of the correct advancement speeds of the material web in relation to the initiation of cutting-off operations, e.g. for producing blanks. In particular, it is possible to counteract tolerance-induced, continuous displacement of cuts which are to be carried out, it being possible for this displacement to result in the cut moving from its correct position. Defective packs are avoided in this way.

The rotational speed of a reel which bears the finishing material web and/or new material web is preferably calculated, and set, in dependence on the degree to which a web store is filled and on the (rotational) speed of the operated machine and/or on the conveying speed of the webs. The respective reel diameter is preferably also taken into consideration here. This coupling of the rotational speed of the reel to the rotational speed of the removal machine has the advantage that the oscillatory deviations of the web store are reduced. This reduces the oscillatory accelerations and/or inertia forces in the web store, with the result that the mechanical stressing in the web is constant. A drive, e.g. a servomotor, predetermines the rotational speed of the finishing reel and/or new reel here. The servomotor is controlled taking into the consideration the oscillatory deviation and machine rotational speed and, in particular, the reel diameter, with the result that the desired reel rotational speed is set.

The remainder or length of the web which is wound up on a reel and/or the reel diameter are/is preferably determined from the angles of rotation of the reel and of a deflection roller which runs along with the web, in particular taking into consideration the circumference of the deflector roller. It is also possible to use the length of a piece of web which is drawn off from the reel and/or the displacement path of a carriage which carries along the web. The angle of rotation of the reel is sensed in this case by an angle-of-rotation sensor. It is likewise possible for the angle of rotation of the running-along deflection roller to be sensed via an angle-of-rotation sensor or a counting mechanism for counting the revolutions of the deflection roller. Furthermore, a sensor on the carrying-along carriage can be used to determine the displacement path of the carriage. These variables pass to a central computing unit, which calculates the reel diameter from the variables. This computing unit can likewise calculate, from the variables sensed, the remainder or length of the web which is wound up on a reel.

BRIEF DESCRIPTION OF THE DRAWINGS

Preferred developments of the invention can be gathered from the subclaims and the description. An exemplary embodiment of the invention is explained in more detail with reference to the drawing, in which:

DETAILED DESCRIPTION OF THE INVENTION

Figure 1:
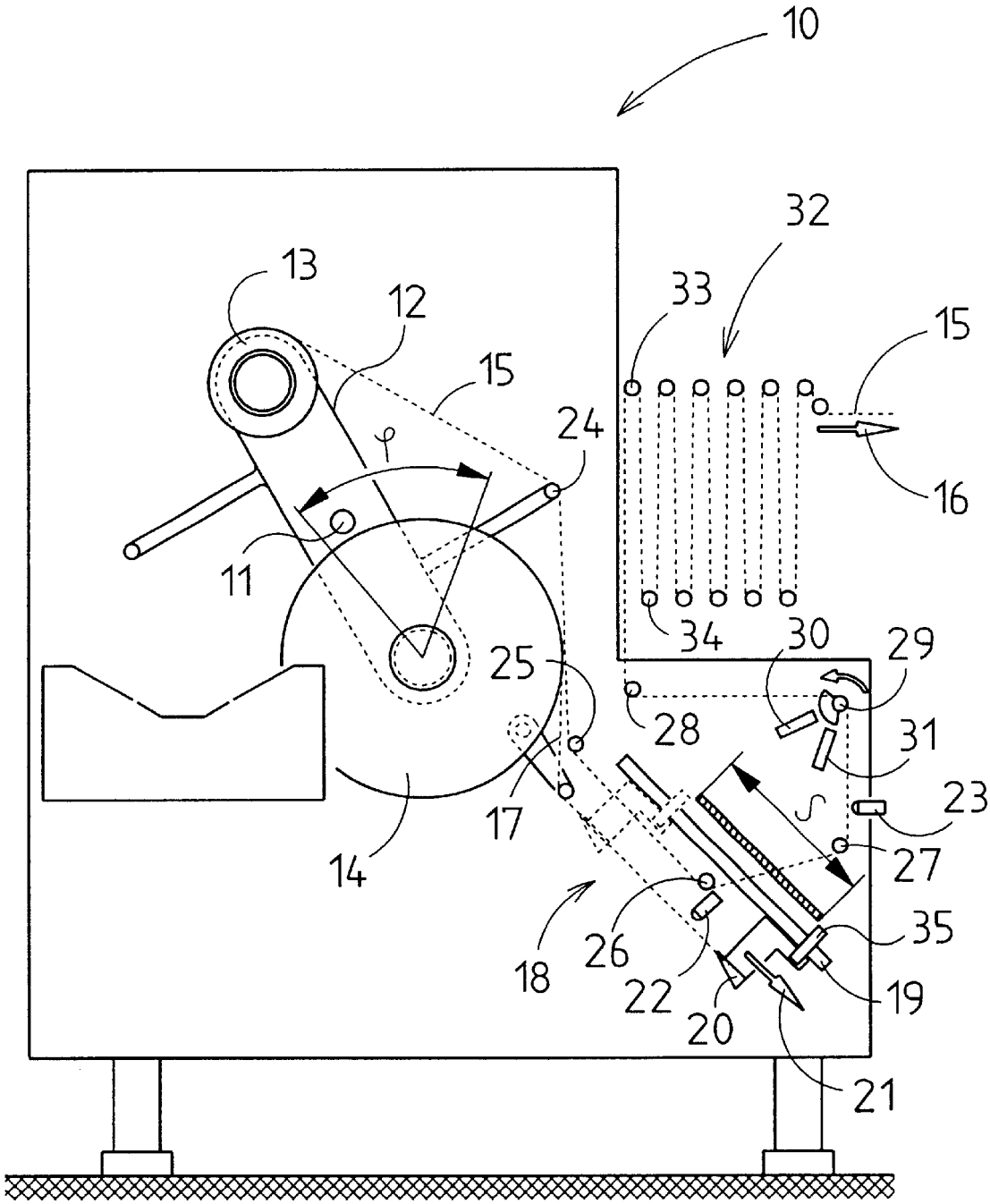
FIG. 1 shows a schematic side view of a material unit of the packaging machine

FIG. 1 shows a schematic view of a material unit 10 of a packaging machine. A finishing reel 13 and a new reel 14 are located at the ends of a reel arm 12, which is mounted such that it can be rotated about a spindle 11. In each case one material web has been wound up on the reels 13, 14. Such material webs are used, in particular, during the production of blanks for cigarette packs and other packaging units which are used in conjunction with the packaging of cigarettes. The material web 15 of the finishing reel 13 is conveyed, in the direction of the arrow 16, to that part of the packaging machine which produces packs from the material web.

When the finishing reel 13 is nearing its end, the finishing material web 15 has to be connected to the new material web 17 of the new reel 14. This connecting operation takes place in a connecting apparatus 18, which has a pneumatically operated linear carriage 19. Located on the linear carriage 19 is a gripper carriage 20, which can be displaced linearly in the direction of the arrow 21, and in the opposite direction, and can be moved in the direction of its dashed-line position in order to grip an end of the new material web 17.

Once the end of the new material web 17 has been gripped, the gripper carriage 20 moves, in the direction of the arrow 21, into its bottom, solid-line position. The precise position is controlled by a sensor in the form of a light scanner 22, which senses printed marks on the material web. The linear carriage 19 thus draws the new material web 17 downwards to the extent where a printed mark is located at a certain position. A second sensor in the form of a light scanner 23 senses the printed marks of the finishing material web 15.

Deflection rollers 24–28 guide the finishing material web 15 from the finishing reel, past the second light scanner 23, to a material store 32. The deflection roller 24 guides the finishing material web 15 past the new reel 14. In the region between the deflection roller 25, 26, the finishing material web 15 is located essentially parallel to the new material web 17.

Arranged between the deflection rollers 27, 28 is a further deflection roller 29, which has a counting mechanism for counting the number of revolutions of the deflection roller 29. From so-called initiators 30, 31, i.e. contactless sensors, the counting mechanism obtains signals, which are counted by the counting mechanism. From the number of revolutions, in particular also from fractions of revolutions, it is possible to infer the length of the material web 15 conveyed past the deflection roller 29. The diameter or circumference of the deflection roller 29 is to be taken into consideration in this case. Revolutions are converted into lengths in a control unit (not illustrated). Alternatively, it is also possible for the length of the conveyed material web 15 to be determined by an angle-of-rotation sensor, likewise taking into consideration the diameter or circumference of the deflection roller 29.

The material store 32 has in each case one row of top deflection rollers 33 and of bottom deflection rollers 34. It serves for compensating for a deceleration in the conveying movement of the finishing material web 15 in the region between the deflection rollers 24 to 28, for example when the finishing material web 15 is connected to the new material web 17. In order to ensure this compensation, the row of bottom deflection rollers 34 is arranged such that it can be adjusted in height. This displaceability makes it possible for the material store 32 to receive different material-web lengths. Alternatively, it is also possible for the row of top deflection rollers 33 to be arranged such that it can be adjusted in height. It is likewise possible for both the top row and bottom row of deflection rollers 33, 34 to be positioned in a height-adjustable manner. It is ultimately a case of changing the positioning of the row of top deflection rollers 33 relative to the row of bottom deflection rollers 34.

When the finishing material web 15 is connected to the new material web 17, the new material web 17 is located in a position in which it has been drawn downwards by the linear carriage 19 and is aligned with a detected printed mark. The finishing material web 15 is decelerated or stopped, to be precise such that a detected printed mark on the finishing material web 15 is located in an appropriate position in relation to the printed mark of the new material web 17. Following this alignment by way of the printed marks, the finishing material web 15 and the new material web 17 are positioned one above the other and connected or adhesively bonded.

Positioned on the gripper carriage 20 is a further initiator 35, which serves for determining the precise position of the gripper carriage 20 on the linear guide 19. It is possible for the displacement path S of the gripper carriage 20 to be determined by way of the position determined for the gripper carriage 20. Furthermore, in each case one angle-of-rotation sensor is located at each end of the reel arm 12—both on the finishing reel 13 and on the new reel 14. The angle of rotation of the respective reel can be sensed by means of said angle-of-rotation sensor. The angle of rotation of the new reel 14 is designated by $\phi$. The reel diameter can be calculated by way of the displacement path S covered by the gripper carriage 20 and the angle of rotation $\phi$ of the new reel 14. The reel diameter is given by the quotient of twice the measure distance and the angle of rotation $\phi$ of the reel, that is to say $$\text{reel diameter} = 2 \cdot \text{displacement path } S / \text{angle of rotation } \phi$$

Figure 2:
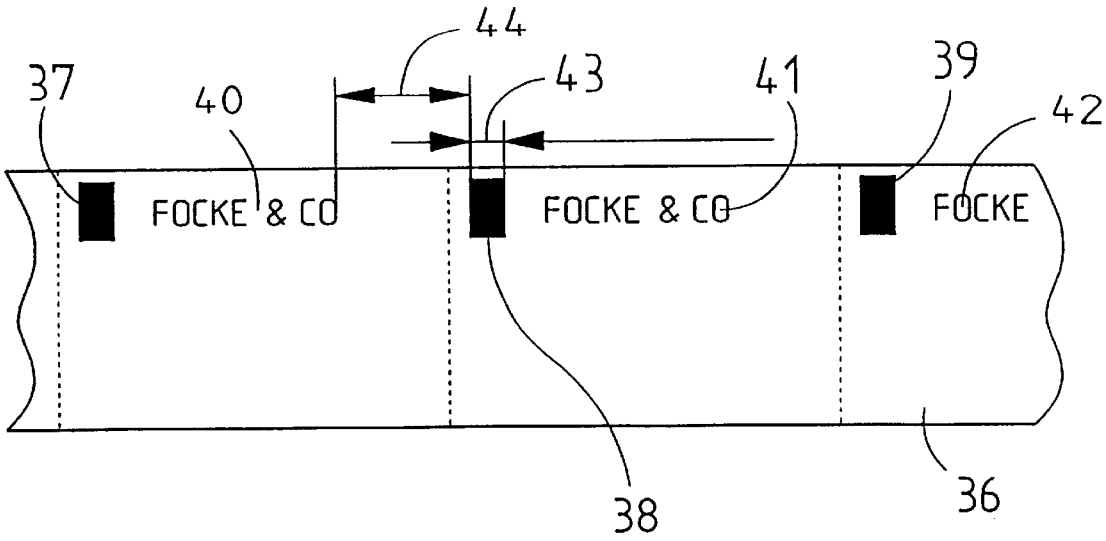
FIG. 2 shows a material web with printed marks and separate prints.

FIG. 2 explains the automatic detection of the correct printed mark and shows a material web 36 with printed marks 37–39. Separate prints 40–42 are located between the printed marks 37–39, and said separate prints are referred to as printed sections. The dashed lines indicate the beginning and end of a blank in each case.

The invention makes it possible to "filter out" from among the printed sections those printed sections which constitute the printed marks. In this case, the correct printed marks 37–39 are detected automatically via two criteria. On the one hand, the width 43 of the printed section is measured, and on the other hand the spacing 44 between two printed sections is measured. The spacing and the width are determined by means of the light scanners 22, 23 and the measured values are fed to an evaluation unit. The evaluation unit has previously obtained reference data for the width of a printed mark and for the spacing between a printed mark and a separate print. The evaluation unit compares a measured width with the previously input width and a measured spacing with the previously input spacing and produces a corresponding signal if the values essentially correspond. This signal produced indicates the detection of a printed mark. These measurements may take place either just for initiating a connecting operation of two material webs or permanently throughout operation of the installation/packaging machine, in particular of the material unit 10.

This method also makes it possible for printed marks to be detected correctly in a reliable manner when separate prints 40–42 are also arranged between the printed marks 37–39, as seen in the movement direction. It is quite possible here for separate prints to be at the same width as the printed marks and nevertheless for it to be possible to distinguish between separate prints and printed marks in a reliable manner since, in addition to the width, the spacing between the printed sections is also taken into consideration.

With the aid of the automatic detection of a printed mark, it is possible to monitor a printed mark throughout the entire unwinding operation. By way of the process described, it is possible for the correct printed mark to be identified even in continuous operation of the installation. A printed mark, once identified, can be followed up by the next printed mark being expected, and detected, at a blank-length spacing.

Figure 3:
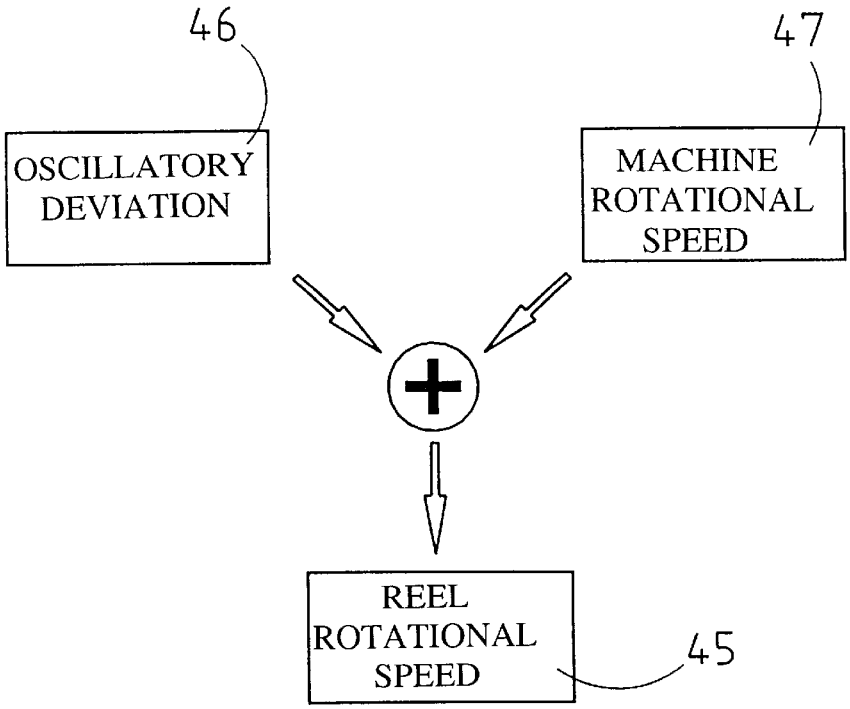
FIG. 3 shows a schematic illustration for determining the desired reel rotational speed.

FIG. 3 explains the reel rotational speeds for driving the active reel, i.e. the reel from which the material web is fed directly to the removal packaging machine. In FIG. 1, this would be the finishing reel 13. The active reel is driven by a motor (not illustrated). The rotational speed of the reel is predetermined by the drive in this case. This rotational speed is illustrated by the bottom block 45.

The reel rotational speed 45 is dependent on the oscillatory deviation, which is illustrated as block 46, and the machine rotational speed, which is illustrated as block 47. In this case, oscillatory deviation means the deviation of the material store 32 from a normal degree of filling, and machine rotational speed means the operating speed of the packaging machine in relation to a rotating reference wheel located in the packaging machine. The machine rotational speed is usually dependent on the conveying speed of the material web in the region of the packaging machine, i.e. in particular in the region downstream of the material store 32.

This method of controlling the reel drive in accordance with a desired reel rotational speed results in a reduction in the oscillatory deviations of the web store and/or in the regulating fluctuations of the material store 32. This achieves more uniform web stressing since, as a result of decreasing oscillatory deviations, the oscillatory accelerations and inertia forces are smaller.

In addition to the oscillatory deviation and the machine rotational speed, it is also possible for the current reel diameter to be included in the calculation of the reel rotational speed. This results in rotational-speed coupling of the removal machine taking into consideration the current reel diameter, and two proportionality factors ($factor_1$, $factor_2$), in accordance with the following equation $$\text{reel rotational speed} = \text{factor}_1/\text{reel diameter}\cdot(\text{machine rotational speed} + \text{factor}_2\cdot\text{oscillatory deviation})$$

In this case, the reel diameter is calculated by way of the following equation $$\text{reel diameter} = \text{revolutions of the deflection roller}\cdot\text{circumference of the deflection roller}/\text{reel angle of rotation}\phi$$

In the example explained, the reel diameter determined can be used for the following operations. First of all, by way of the reel diameter, it is possible to predict the end of the finishing material web and, accordingly, to start the splicing operation just before the finishing material web runs of. Secondly, by way of the reel diameter, the angle of rotation $\phi$ of the reel can be converted into a material-web length. Thirdly, with the aid of the reel diameter, the reel rotational speed can be adapted to the rotational speed of the removal machine.

The determination of the reel diameter thus permits a wide range of application areas. In particular in conjunction with the printed-mark detection according to the invention, there is the possibility of efficient and disruption-free connection of a finishing material web to a new material web.

LIST OF DESIGNATIONS

10 material unit
11 spindle
12 reel arm
13 finishing reel
14 new reel
15 finishing material web
16 arrow
17 new material web
18 connecting apparatus
19 linear carriage
20 gripper carriage
21 arrow
22 light scanner
23 light scanner
24 deflecting roller
25 deflecting roller
26 deflecting roller
27 deflecting roller
28 deflecting roller
29 deflecting roller
30 initiator
31 initiator
32 material store
33 top deflecting roller
34 bottom deflecting roller
35 initiator
36 material web
37 printed mark
38 printed mark
39 printed mark
40 separate print
41 separate print
42 separate print
43 width of a printed section
44 spacing between printed sections
45 reel rotational speed
46 oscillatory deviation
47 machine rotational speed
S displacement path
$\phi$ angle of rotation

What is claimed is:

1. A process for severing or connecting moving webs (15, 17) which have printed sections at regular spacings with printed marks (37, 38, 39) and separate prints (40, 41, 42) in the same path of movement as the printed marks, said process comprising the steps of:

determining widths (43) of the printed marks, and regular spacings (44) between adjacent printed sections, and, when a width (43) and a spacing (44) essentially correspond to respective predetermined values, detecting a printed section as being a printed mark (37, 38, 39);

in response to a detected printed mark (37, 38, 39), initiating an operation for connecting a finishing web (15) to a new web (17) to connect the finishing web (15) and the new web (17) in a correctly positioned manner such that the printed marks (37, 38, 39), in a connecting region of the webs, also have spacings corresponding to the regular spacings of the printed marks (37, 38, 39) on the moving webs;

determining a remaining length, of a web (15, 17) wound on a reel (13, 14), and the reel diameter from an angle of rotation (ϕ) of the reel, and from an angle of rotation of a deflection roller which runs along with the web, by taking the circumference of the deflection roller into account, or from a length of a piece of web which is drawn off the reel (13, 14), and from a displacement path of a carriage (19, 20) which carries along the web; and using the reel diameter for converting measured angle-of-rotation values (ϕ) of the reel into web lengths, wherein the reel has a rotational speed equal to:

$factor_1$/reel diameter * (machine rotational speed + $factor_2$ * oscillatory deviation), wherein $factor_1$ and $factor_2$ are proportionality factors.

2. The process according to claim 1, wherein a point in time of the severing or connecting is determined from the angle of rotation (ϕ) of the reel and the angle of rotation of the deflection roller which runs along with the web, or from the length of the piece of web drawn off from the reel (13, 14) and from the displacement path of a carriage (19, 20) which carries along the web.

3. The process according to claim 1, wherein a rotational speed, which is to be set for a finishing reel or a new reel is dependent on the degree to which a web store (32) is filled and on a conveying speed of the web, each reel rotational speed in particular also being calculated in dependence on the respective reel diameter.

4. The process according to claim 3, wherein, at the start of a web connecting operation, the web store (32) is essentially completely full.

5. An apparatus for severing or connecting moving webs (15, 17) which have printed sections at regular spacings with printed marks (37, 38, 39) and separate prints (40, 41, 42) in the same path of movement as the printed marks, said apparatus comprising a sensor (22, 23) for scanning the printed sections, and an evaluation unit which is connected to the sensor (22, 23), and which, in response to a sensor signal, determines widths (43) of the printed marks, and spacings (44) between adjacent printed sections, and, when a width (43) and a spacing (44) essentially correspond to predetermined respective values, detects a printed section as being a printed mark (37, 38, 39);

said apparatus also comprising:

means for connecting a finishing web (15) to a new web (17) so that the finishing web (15) and the new web (17) are connected in a correctly positioned manner such that, in a connecting region of the finishing and new webs, the printed marks (38, 39, 40) are at spacings which correspond to said regular spacings of the printed marks (38, 39, 40) on the webs;

an angle-of-rotation sensor for measuring an angle of rotation (ϕ) of a reel onto which a web (15, 17) has been wound;

an angle-of-rotation sensor for measuring an angle of rotation (ϕ) of a deflecting roller (29) which runs along with the finishing web (17);

a counting mechanism for counting the revolutions of the deflecting roller (29); and a sensor (35) for sensing the length of a piece of web which is drawn off from the reel (13, 14), and for sensing a displacement of a carriage (19, 20) which carries along a web (13, 14).

6. The apparatus according claim 5, wherein there is one said sensor for sensing the printed sections on each of the finished web (15) and the new web (17).

* * * * *